United States Patent [19]

Liătaud et al.

[11] 4,376,234

[45] Mar. 8, 1983

[54] DIP SWITCH

[76] Inventors: James P. Liătaud, 70 Bluff Rd., Cary, Ill. 60013; David L. Maloney, 435 Valley View, Barrington, Ill. 60010

[21] Appl. No.: 260,821

[22] Filed: May 5, 1981

[51] Int. Cl.[3] ..... H01H 15/00

[52] U.S. Cl. ..... 200/16 R; 200/16 D; 200/291; 200/252

[58] Field of Search ..... 200/16 R, 16 A, 16 B, 200/16 C, 16 D, 291, 327, 333, 252, 260

[56] References Cited

U.S. PATENT DOCUMENTS

| | | | |
|---|---|---|---|
| Re. 17,897 | 12/1930 | Bramming | 200/16 D |
| 3,504,140 | 3/1970 | Atkinson | 200/16 C |
| 4,012,608 | 3/1977 | Lockard | 200/16 R |
| 4,072,833 | 2/1978 | Carena | 200/16 D |
| 4,268,728 | 5/1981 | Rose | 200/16 D |

OTHER PUBLICATIONS

MINI-DIP 2400 Series brochure of EECO.

*Primary Examiner*—A. T. Grimley
*Assistant Examiner*—Morris Ginsburg
*Attorney, Agent, or Firm*—Hill, Van Santen, Steadman, Chiara & Simpson

[57] ABSTRACT

A miniature switch adapted for printed circuit board mounting has a plurality of switch sections in a rectangular housing constructed of insulating material. Terminal leads project from opposite side walls of the housing and a pocket within the housing has a plurality of springy bridge-like slide contacts which are selectively movable into contact with contact surfaces formed by extensions of the respective terminal leads. The housing includes a base and a cover portion, and the slide contact is biased against the contact surfaces when the cover is placed on the base.

24 Claims, 14 Drawing Figures

FIG. 1
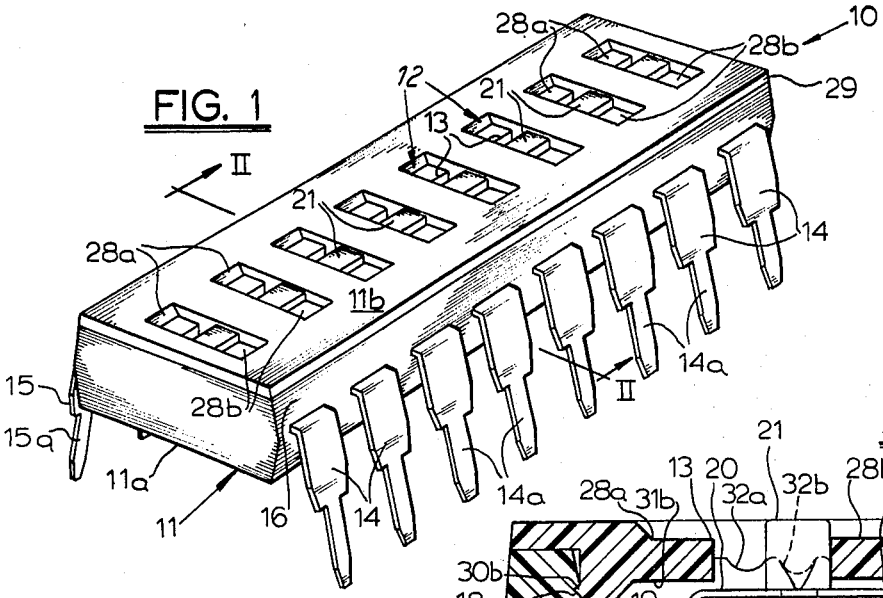
FIG. 2
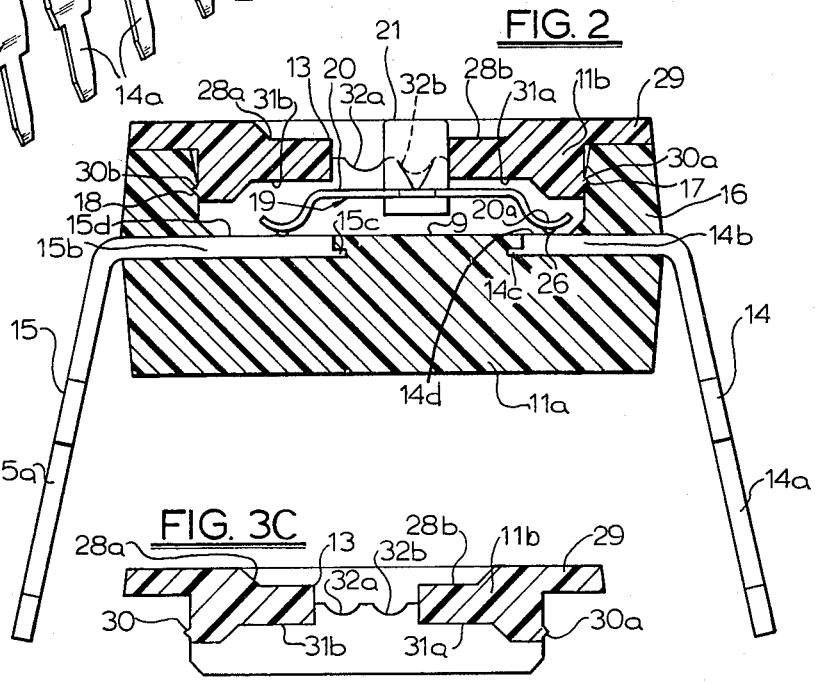
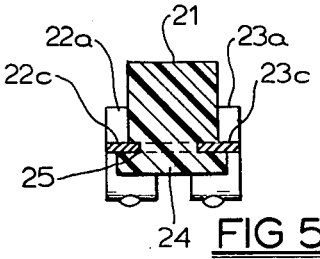
FIG 5A
FIG. 3C
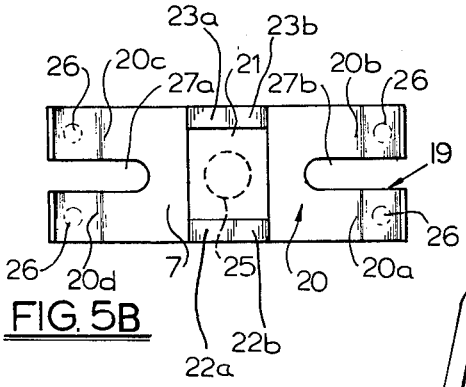
FIG. 5B
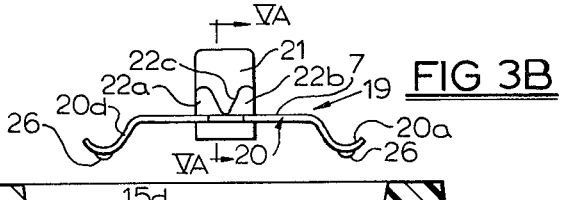
FIG 3B
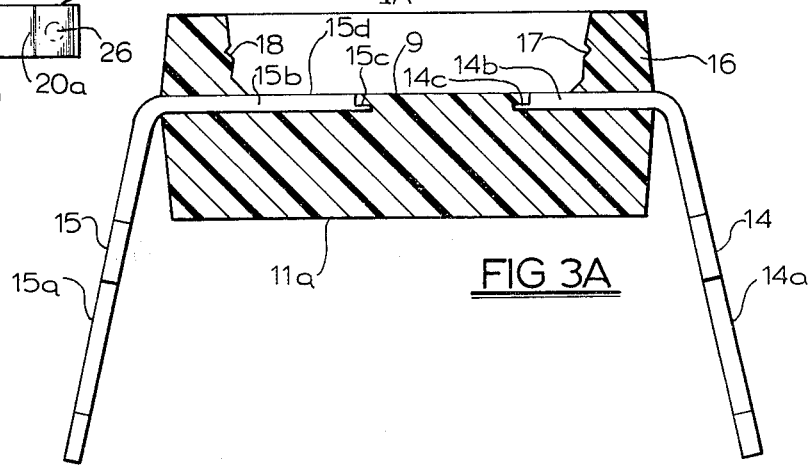
FIG 3A FIG. 4
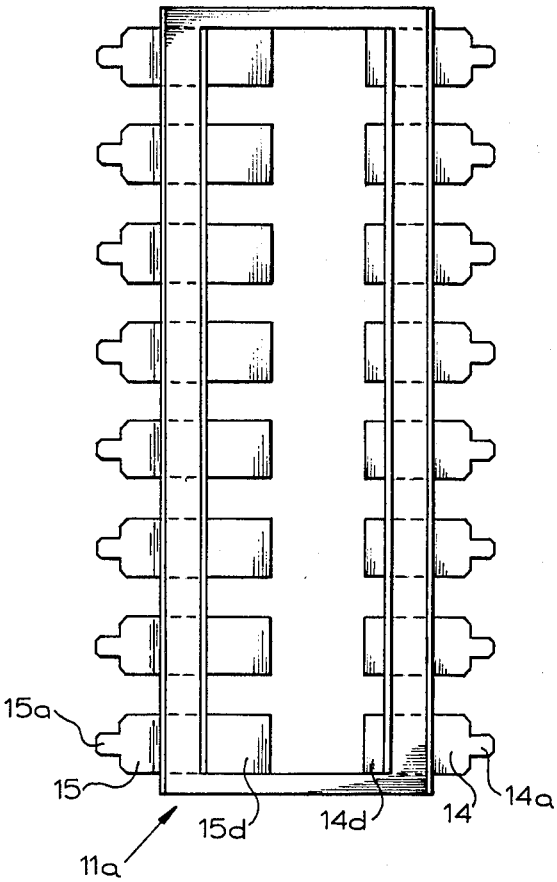
FIG. 6
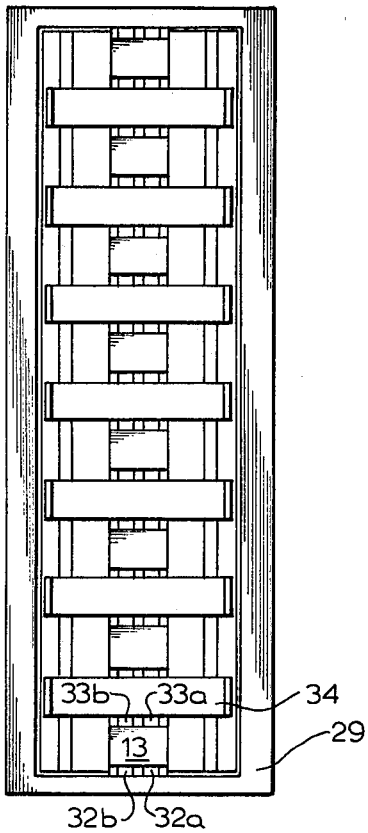
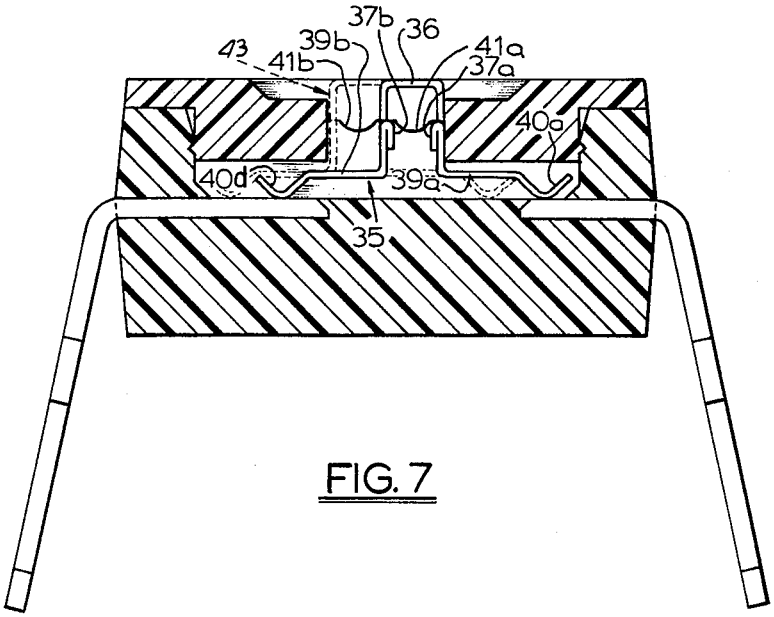
FIG. 7

DIP SWITCH

BACKGROUND OF THE INVENTION

A switch is known which is adapted for printed circuit board mounting which has a plurality of switch sections with each switch section capable of being independently actuated by a user. If each switch section has two positions, for example, and if eight switch sections are provided, then the user may selectively encode the switch by actuating certain ones of the eight switches so as to establish a particular coding desired. For example, in electronic devices such as garage door openers it is desirable for security reasons to have each individual unit set with a predetermined coding so that other similar units cannot open the garage door. Consequently, either the user or the manufacturer prior to sale of the particular unit will set the multiple section switch elements in a predetermined pattern in both the receiver and the transmitter so that the given transmitter is only compatible with the given receiver.

In the past, such switches have experienced reliability problems as a result of sporadic contacting within the switches. Also, such prior art switches were expensive to manufacture and/or were of bulky construction.

SUMMARY OF THE INVENTION

It is an object of this invention to reduce the cost of manufacturing a switch of the above-described type.

It is a further object of the invention to improve the reliability of contact of a switch in accordance with the design described above.

It is another object of the invention to reduce the size of the switch while maintaining low cost construction consistent with high reliability.

According to the invention, a housing of insulating material is provided with a plurality of terminal leads projecting from opposite side walls of the housing. A pocket is formed within the housing which has a floor portion which for each switch section has associated first and second exposed contact surfaces thereat which are connected to the respective terminal leads associated with the switch section. A metal springy bridge-like slide contact is provided for each switch section within the pocket and which has contact projections at opposite ends thereof for selective contact with the contact surfaces when the slide contact is moved. A cam system is provided preferably embodied as a notch on a post portion of the slide contact which cooperates with depending bumps from a ceiling of the pocket so as to stabilize the slide contact in a desired contact position. An aperture is provided in the housing for each switch section through which a portion of the slide contact may be physically actuated. The pocket is dimensioned such that a ceiling portion thereof biases the springy bridge-like slide contact against the contact surfaces of the floor portion.

Preferably the housing includes a base having side walls and a cooperating cover. The bumps of the cam system preferably project downwardly from alongside an aperture in the cover for each switch slide contact.

BRIEF DESCRIPTION OF THE DRAWINGS

FIG. 1 is a perspective view of the improved miniature switch of the invention;

FIG. 2 is a cross-sectional view taken along line II—II of FIG. 1;

FIGS. 3A, 3B and 3C are an exploded view of the various principal parts utilized in constructing the switch of FIG. 1;

FIG. 4 is a top view of a base part of the switch of FIG. 1;

FIG. 5A is a cross-sectional view taken along VA—VA of FIG. 3B;

FIG. 5B is a top view of the slide contact part illustrated in FIG. 3B;

FIG. 6 is a bottom view of a cover part illustrated in FIG. 3C;

FIG. 7 is a side cross-sectional view similar to FIG. 2 of an alternate embodiment of the invention;

DESCRIPTION OF THE PREFERRED EMBODIMENTS

Figure 8:
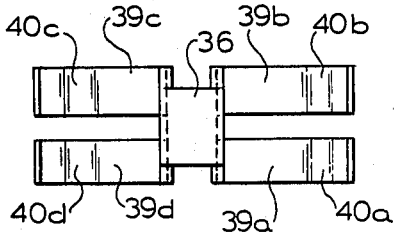
FIG. 8 is a top view of the slide contact employed in the alternate embodiment of FIG. 7.

The miniature printed circuit switch of the invention is generally illustrated at 10 in FIG. 1. This type of switch is also known as a "DIP" switch, and is readily adapted for printed circuit board mounting by use of the downwardly bent terminal leads having shoulders thereon. The switch has a housing 11 which encloses the various switch sections. This housing is formed of a base 11*a* and a cooperating cover 11*b* both of a thermal plastic insulating material. Separate switch posts 21 are provided for each switch section 12 the switch posts projecting through slots or apertures 13.

On opposite side walls of the housing, terminal or connection leads 14 project which have narrowed portions 14*a* functioning as insertion pins for PC board mounting. On the opposite side of the housing similar terminals 15 with narrowed portions 15*a* are provided.

As shown most clearly in FIGS. 2, 3A and 4, the base 11*a* has an outer peripheral wall 16 which is molded around the various connection leads at secured portions 14*b* and 15*b*. Exposed contact surfaces 14*d* or 15*d* are provided on a floor portion 9 of the base 11*a*, and are preferably flush therewith. A retaining lip 14*c* or 15*c* is provided below a surface of the floor 9 to assist in retaining this portion of the contact surface embedded in the floor.

Interior surfaces of the side walls have notches 17 or 18 for securing the cover 11*b* in place by engagement with corresponding projections 30*a* and 30*b* on the cover 11*b*.

Details of a slide contact 19 employed for each switch section are most apparent from FIGS. 2, 3B and 5A, B. The slide contact 19 has a contact element 20 with a flat horizontal portion 7 and downwardly bent and curved portions 20*a,b,c* and *d* serving as contact legs. An actuating post or knob 21 provided of thermal plastic as an insulating material is mounted on the bridge-like slide contact element 20. The post 21 has laterally projecting shoulder portions 22*a,b* on one side and 23*a,b* on the other which have a slanted surface terminating in a rounded portion at the top so as to form respective V-style notches 22*c* and 23*c* on each side of the post 21. A base portion 24 is provided below the bridge-like slide contact element 20 so as to mold the post in the mounting aperture 25.

As illustrated in FIG. 5B a dimple contact 26 is provided at the bottom end of each of the contact legs. The contact legs on a given side are separated by respective separation slots 27*a,b*.

As illustrated in FIGS. 2, 3C and 6 the top cover 11*b* has cut away access portions 28*a,b* on opposite sides of aperture 13 to facilitate user access to the switch posts so as to change positions of each of the switches. A peripheral thinner surface portion 29 rests on a top surface of the peripheral wall 16 of the base 11*a*.

On the underside of the cover 11*b* a cut away portion 31*a,b* is provided to form a portion of a ceiling of the pocket for each of the switch sections.

As illustrated most clearly in FIG. 6, the physical position of each switch section is defined by cam projections 32*a,b* depending from a ceiling of the pocket formed by the lower surface of the cover 11*b*. These cam projections are in the shape of a double hump. These cam projections 32*a,b* are provided on one side of the aperture while similar projections 33*a,b* are provided on the opposite side. These cooperate with the previously described V-shaped notches on the switch section posts.

Dividing wall sections 34 depend downwardly from the cover 11*b* to form support struts and also to form dividing walls for sub-pockets for each of the switch sections. They also can serve as a guide for the slide contacts.

FIGS. 3A, 3B and 3C illustrate in side view the various principle parts employed in assembling the inventive switch described herein. As the cover is placed over the contact slide element, it is biased in a compression manner so as to increase contact reliability between each of the contact legs and the contact surfaces. Also, when assembled the tops of the switch posts are flush with the top surface of the cover 11*b* and thus reduce the overall thickness of the inventive switch.

Figure 9:
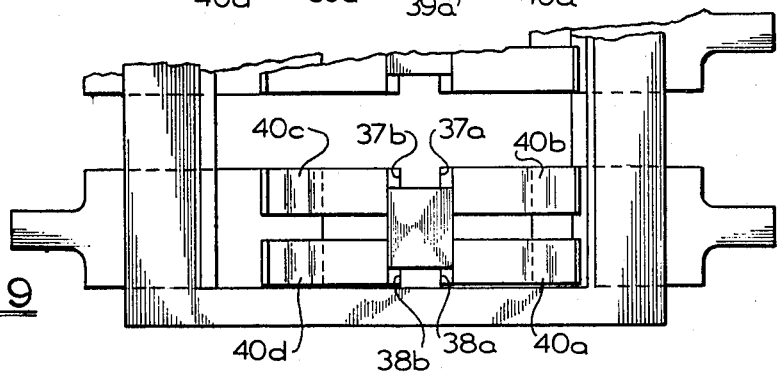
FIG. 9 is a top view of one of the switch sections of the alternate embodiment of FIG. 7.

An alternate embodiment of the invention is shown in FIGS. 7, 8 and 9 wherein the thermal plastic post of the switch shown in FIG. 2 is replaced by forming a continuous metal strip as the bridge-like slide contact 35 with a central U-shaped portion 36. This U-shaped portion has shoulders created by bent down tabs 37*a,b* on one side or 38*a,b* on the other. Each slide contact has two legs 39*a,b* and 39*c,d* on each side for contact in a manner similar to the switch of FIG. 2. Each of these legs has a V-shaped contact portion 40*a,b,c,d*. Cams or bumps 41*a,b* are provided on each side of the aperture to engage with the previously described shoulder portions. Reference numeral 43 illustrates an alternate position of the slide contact 35.

Figure 10:
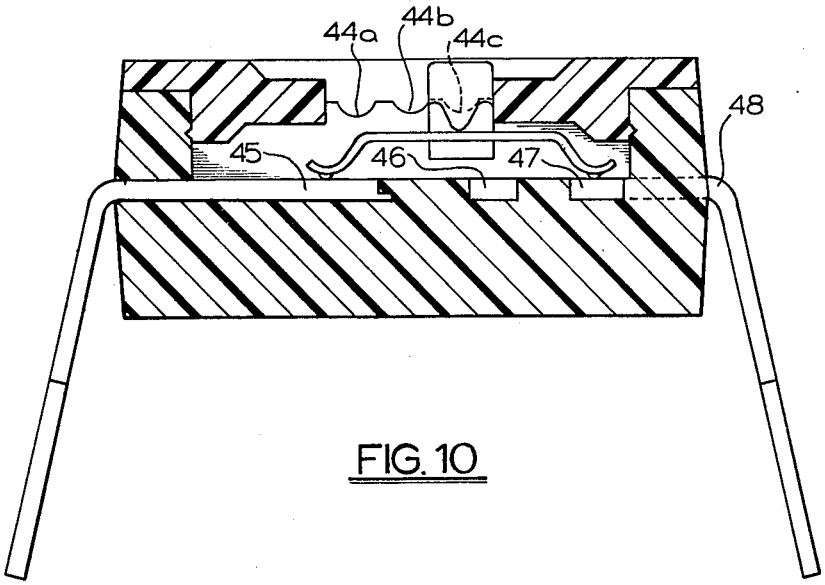
FIG. 10 is an end cross-sectional view illustrating a second alternate embodiment of the switch showing FIG. 2.
Figure 11:
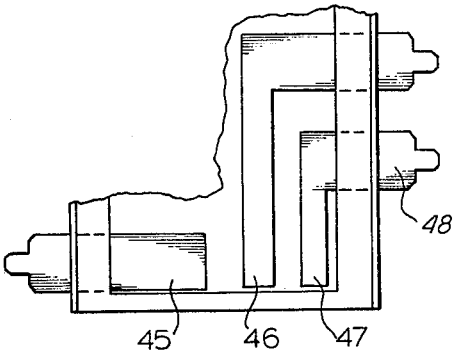
FIG. 11 is a schematic illustration of the contact positions for a section of the switch illustrated in FIG. 10.

In a further embodiment of the invention shown in FIGS. 10 and 11, a slide contact somewhat similar to FIG. 2 is provided but which is designed for a three position operation for each switch section. Here, three projections 44*a*, 44*b* and 44*c* are provided which cooperate with the V-shaped notch. Similarly a long contact surface 45 is provided together with an intermediate contact surface 46, and further contact surface 47. FIG. 11 illustrates the lay out of the various contact surfaces including terminal lug 48.

With the invention, the size of the switch is reduced while maintaining low cost. At least eight switch sections are provided per inch along a longitudinal direction of the rectangular housing 11. Preferably the housing has a thickness less than $\frac{1}{4}$ inch and may be as thin as approximately $\frac{1}{8}$ inch.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A miniature switch having a plurality of switch sections, comprising:

a rectangular housing made of an insulating material;

a plurality of terminal leads projecting from opposite walls of the housing;

an inside of the housing having a floor portion which for each switch section has aligned first and second exposed contact surfaces thereat which are extensions of respective terminal leads associated with the switch section;

a metal springy bridge-like slide contact for each switch section within the housing and having a substantially flat central portion and downwardly bent and laterally outwardly extending curved portions forming contact projections at opposite ends thereof, a contact projection at one end being in continuous contact with the first contact surface nearest said one end of the slide contact in either of two switch positions and being dimensioned so that a contact projection at the other end selectively contacts the second contact surface in one of the switch positions but not the other;

a post-like projection directly attached at said flat central portion;

a cam means comprising a notch and cooperating cam projection, one of the notch and cam projection being formed on said post-like projection and the other at a ceiling of an interior surface of the housing to mechanically define the two switch positions;

an aperture in the housing for each switch section through which the post-like projection extends and by which the slide contact may be physically positioned; and the inside of the housing being dimensioned such that a ceiling portion thereof biases the slide contact through said cam means against the contact surfaces at the floor portion.

2. A switch according to claim 1 wherein the slide contact has two projecting contact legs at each end thereof.

3. A switch according to claim 1 wherein the curved portions have projecting dimples therein.

4. A switch according to claim 1 wherein the cam means comprises a notch on the slide contact which cooperates with two projecting bumps depending from a ceiling within the housing.

5. A switch according to claim 1 wherein said post-like projection comprises an insulating post is secured only at the central portion of the slide contact and which projects through said aperture at a top of the housing.

6. A switch according to claim 5 wherein the cam means comprises a notch provided at a lateral portion of the post and two projecting bumps which cooperate with the notch depending from a ceiling within the housing directly adjacent the aperture.

7. A switch according to claim 1 wherein the slide contact has a central portion bent in a U-shape to form said post-like projection which projects downwardly from a ceiling within the housing.

8. A switch according to claim 7 wherein shoulders are provided on the U-shape which cooperate with two bumps depending downwardly from a ceiling within the housing.

9. A switch according to claim 1 wherein the first and second contact surfaces are flush with the floor portion within the housing and having a retaining lip extending in a longitudinal direction from an end thereof which is below the floor portion so as to effectively secure the first and second contact surfaces in position.

10. A switch according to claim 1 wherein the housing comprises a base having a peripheral wall extending upwardly therefrom which mates with a cover.

11. A switch according to claim 10 wherein the post-like projection of the slide contact projects through the aperture for each switch section and wherein a recess is provided on an exterior surface of the cover adjacent the aperture which is dimensioned to permit access to the slide contact post-like projection to push the slide contact into either of the two positions.

12. A switch according to claim 11 wherein the post-like projection of the slide contact has a top surface flush with a top surface of the cover.

13. A switch according to claim 1 wherein the terminal leads have narrowed portions adapted for plugging into a printed circuit board, shoulder portions of the terminal leads at a beginning of the narrowed portions forming abutment shoulders when the switch is mounted in the printed circuit board.

14. A switch according to claim 1 wherein at least six switch sections are provided per inch along a longitudinal direction of the rectangular housing.

15. A switch according to claim 14 wherein at least eight switch sections are provided per inch along the longitudinal direction.

16. A switch according to claim 14 wherein the housing has a thickness less than $\frac{1}{4}$ inch.

17. A switch according to claim 16 wherein the housing thickness is approximately $\frac{1}{8}$ inch.

18. A switch according to claim 1 wherein the housing has a cover provided with transverse ribs formed within the housing which substantially divide an interior of the housing into a plurality of areas, one for each switch section.

19. A switch according to claim 1 wherein the housing comprises a base with side walls and a cover, and wherein projection means are provided between the side walls and the cover for retaining the cover at the side walls.

20. A switch according to claim 1 wherein the slide contact is a metal strip having a central U-shaped portion serving as said post-like projection for pushing the slide contact, and at a lateral portion of the U-shaped portion, tabs are cut away and bent downwardly so as to provide shoulders on the post-like projection which cooperate with bumps to provide said cam means.

21. A switch according to claim 1 wherein each switch section has three positions and the cam means comprises three bumps projecting from a ceiling of the inside of the housing downwardly, and wherein a third contact surface is provided at the floor portion of the inside of the housing which contact surface contacts with further terminal leads projecting from the housing.

22. A miniature switch, comprising:

a rectangular housing;

at least six switch sections per inch along a longitudinal direction of the rectangular housing;

a plurality of terminal leads projecting from opposite side walls of the housing;

an inside of the housing having a floor portion which for each switch section has first and second exposed contact surfaces which are extensions of respective terminal leads associated with the switch sections;

a metal springy bridge-like slide contact for each switch section within the housing and having a substantially flat central portion and downwardly bent and laterally outwardly extending curved portions forming contact projections at opposite ends thereof, a contact projection at one end being in continuous contact with the first contact surface nearest said one end of the slide contact in either of two switch positions and being dimensioned so that a contact projection at the other end selectively contacts the second contact surface in one of the switch positions but not the other;

a post-like projection attached at said flat central portion and having first and second notches on opposite sides of the projection;

an aperture in the housing for each switch section through which the post-like projection attached to the slide contact projects to permit slide positioning of the slide contact;

at the aperture, cam projections being provided at opposite sides thereof so as to cooperate with the notches on opposite sides of the post-like projection; and the inside of the housing being dimensioned such that a ceiling portion thereof biases the slide contact against the contact surfaces at the floor portion by pressure applied by the cam projections on the notches of the post-like projection.

23. A miniature switch, comprising:

a rectangular housing;

at least six switch sections per inch along a longitudinal direction of the rectangular housing;

a plurality of terminal leads projecting from opposite side walls of the housing;

an inside of the housing having a floor portion which for each switch section has first and second exposed contact surfaces which are extensions of respective terminal leads associated with the switch sections;

a slide contact assembly having only two pieces, namely a metal springy bridge-like slide contact and a post-like projection directly connected thereto, said assembly having a first cam means;

said slide contact being in slidable contact making association with the exposed contact surfaces for each switch section within the housing and having a central portion and downwardly bent and laterally outwardly extending curved portions, each curved portion having two legs forming two contact projections at each end of the slide contact;

said post-like projection being directly attached at said central portion;

an aperture in the housing for each switch section through which the post-like projection attached to the slide contact projects to permit slide positioning of the slide contact;

second cam means inside the housing cooperating with the first cam means; and the inside of the housing being dimensioned such that a ceiling portion thereof biases the slide contact against the contact surfaces at the floor portion by pressure applied on the bridge-like slide contact through the post-like projection.

24. A miniature switch, comprising:

a rectangular housing;

a plurality of terminal leads projecting from opposite side walls of the housing;

an inside of the housing having a floor portion which for each switch section has first and second exposed contact surfaces which are extensions of respective terminal leads associated with the switch sections;

a metal springy bridge-like slide contact in slidable contact making association with the exposed contact surfaces for each switch section within the housing and having a central portion and downwardly bent and laterally outwardly extending curved portions forming contact projections at opposite ends thereof;

a post-like projection attached at said central portion and having first cam means on the projection;

an aperture in the housing for each switch section through which the post-like projection attached to the slide contact projects to permit slide positioning of the slide contact;

at the aperture, second cam means being provided at an inside ceiling of the housing so as to cooperate with the first cam means;

the inside of the housing being dimensioned such that a ceiling portion thereof pushes the central portion of the slide contact toward the floor portion and biases the slide contact against the contact surfaces at the floor portion by pressure applied through the cam means; and the post-like projection being molded in a mounting aperture at the slide contact central portion and having a base portion below the slide contact in proximity to the housing floor portion.

* * * * *